United States Patent [19]

Bisbing

[11] 4,230,351

[45] Oct. 28, 1980

[54] LINK AND LEVER OPERATED TOGGLE LATCH MECHANISM

[75] Inventor: Robert H. Bisbing, Springfield, Pa.

[73] Assignee: Southco, Inc., Concordville, Pa.

[21] Appl. No.: 906,074

[22] Filed: May 15, 1978

[51] Int. Cl.[3] ..... E05C 3/08

[52] U.S. Cl. ..... 292/223; 292/DIG. 49

[58] Field of Search ..... 292/DIG. 49, 223, DIG. 71, 292/196, 97, 123

[56] References Cited

U.S. PATENT DOCUMENTS

| | | | |
|---|---|---|---|
| 2,101,337 | 12/1937 | Komenak | 292/DIG. 49 |
| 3,446,524 | 5/1969 | Barry | 292/223 |
| 3,924,884 | 12/1975 | Christie | 292/196 |

FOREIGN PATENT DOCUMENTS

| | | | |
|---|---|---|---|
| 1143736 | 2/1963 | Fed. Rep. of Germany | 292/223 |
| 337792 | 3/1936 | Italy | 292/196 |

*Primary Examiner*—Richard E. Moore
*Attorney, Agent, or Firm*—Paul & Paul

[57] ABSTRACT

A latching mechanism is provided for latching a door to a fixed frame member. A keeper is secured to the frame member. A support structure is secured to the door for pivotally mounting a pawl and a pawl-actuating lever for pivotal movement about first and second fixed axes, respectively. The pawl and lever are interconnected by a link bar, secured by first and second pivot pins, respectively. When the lever is in a latched position, forces applied to the door in a door-opening direction impose a compressional load on the interconnecting link bar. When the lever is moved between latched and unlatched positions, an extension of the line drawn between the first and second pivot pins of the link bar will pass across the fixed axis about which the lever is pivotal. Thus, the link bar functions as a over-center toggle element which is placed under a compressional load when forces are applied to the door in a door-opening direction. The lever functions as a first class lever in which the lever fulcrum is located between the link pivot pin which couples the link bar to the lever and the manually operated end of the lever.

1 Claim, 7 Drawing Figures

LINK AND LEVER OPERATED TOGGLE LATCH MECHANISM

Background of the Invention

This invention relates to latching devices for mounting on a door or the like and having a latching pawl for engaging a keeper mounted on the floor frame.

The invention relates to latching devices of the above type which are actuated by a manually operable lever which is operative through an over-center toggle-link mechanism to actuate the latching pawl into latching engagement with the keeper.

The invention relates to latching devices of the above type capable of providing a high degree of gasket compression, as for sealing doors.

The invention also relates to latching devices of the above type which provide a high degree of latching force adapted to resist thrust forces imposed against the door in a door-opening direction.

The invention also relates to latching devices of the above type which are adapted to provide a high degree of leverage for loosening a stuck or frozen door. A latching device of the above type having the characteristics indicated above is disclosed in U.S. Pat. No. 3,446,524 granted May 27, 1969 to John K. Barry and assigned to the assignee of the present application.

In U.S. Pat. No. 3,446,524, a link 58 is connected by a link pin 50 to a pawl 42 and is connected by a link pin 57 to a lever 51. In the said patent, when the lever 51 is moved from the unlatched position shown in FIG. 4 to the latched position shown in FIG. 3, a straight line drawn through the link pins 50 and 57 will pass across the center of location of the fixed pivot 55 of lever 51. Because this center line of the link 58 will pass across the location of the fixed pivot of the lever, it is necessary to use two spaced-apart pins, such as pins 55 and 56 seen in FIGS. 2 and 5 of the patent, or, alternatively to provide a notch in the link to provide a recess for receiving a single straight through pin.

Where two spaced-apart pins, such as 55,56 of the patent, are used, a problem is created because each pin is supported at only one end, as seen best in the patent FIG. 5. When a heavy load is imposed, the pins 55,56 tend to tilt and to deform the walls of the holes in which the pins are supported. If this problem is sought to be corrected by using a single pin and a notch in the link 58 for receiving this pin, the notch tends to weaken the link and the link may bend or break under heavy load.

Summary of the Invention

A principal object of the present invention is to provide a latching device of the general type shown in U.S. Pat. No. 3,446,524 but which avoids the problem referred to above.

In the latching mechanism of the present application, when the lever is operated, the center line of the link itself does not pass through the center of the fixed location of the pivot pin of the lever. Instead, it is the extension of the center line of the link which will cross the center of the fixed location of the pivot pin of the lever.

A second difference between the design of the patent and the design of the present application is that in the patent the lever is a second class lever whereas in the present application the lever is a first class lever. This statement is based on the fact that in both designs the lever pivot pin is the fulcrum. In the patent, the link pin 57, which is connected to the lever 51 is located to the right of the fulcrum 55. In the new design of the application, the link pin 53, which is connected to the lever 50, is located to the left of the fulcrum 65. This defines the patented design as being closest to a second class lever, whereas the new design of the present application is closest to a first class lever.

A further difference between the patented design and the design of the present application is that in the patented design, the link is loaded in tension while in the design of the present application the link is loaded in compression. This, in itself, is not, however, an important difference. The important difference is that in the design of the present application, when the lever is operated, the center line of the link itself does not pass across the center of the fixed location of the fulcrum pin of the lever. It is the extension of the center line of the link which passes across the fulcrum pin.

Description of the Preferred Embodiments

Figure 1:
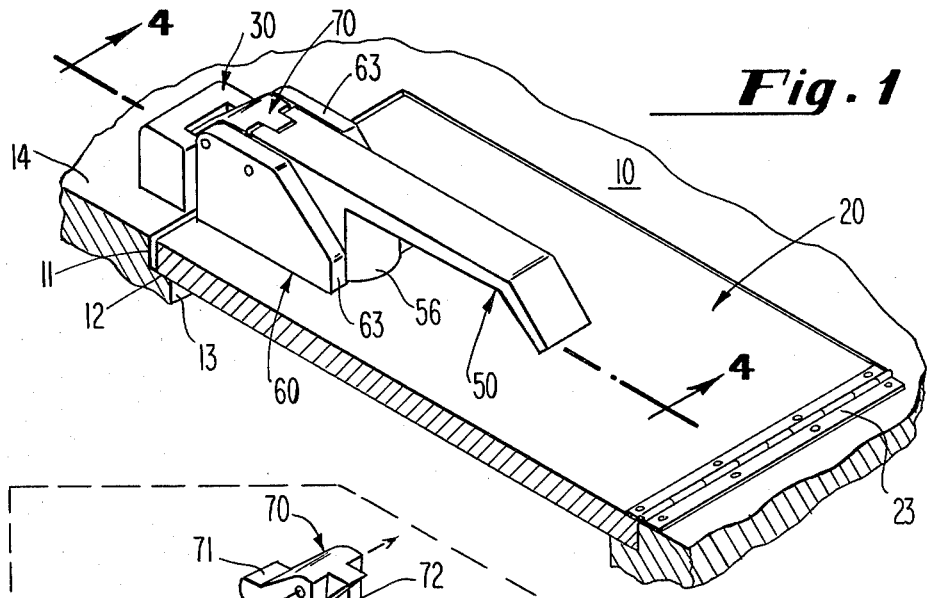
FIG. 1 is a top perspective view of a fragment of a door and frame, illustrating the latching device of the present application attached thereto, the door being shown in a closed latched position.

In FIG. 1, a fragment of a frame 10 is shown having a door 20 inserted therein. Only a fragment of the door is shown. The frame 10 has a jamb having a vertical portion 11 and a horizontal portion 12 terminating in a vertical free edge 13 which defines a rectangular opening inwardly of the door 20. Door 20 is connected to the frame 10 by a suitable hinge 23.

Figure 2:
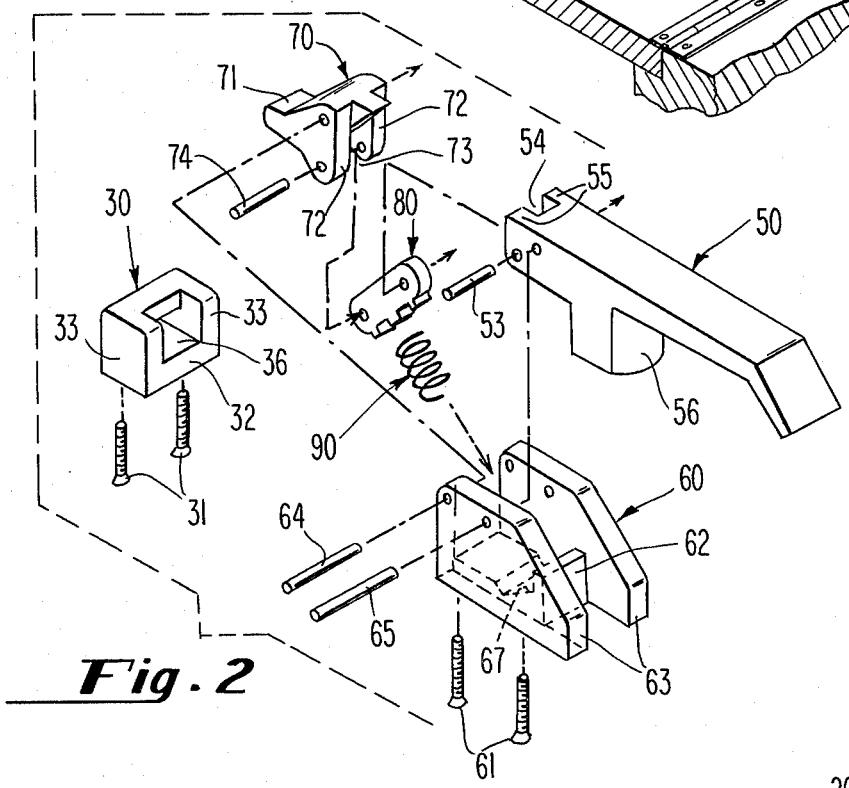
FIG. 2 is an exploded view showing the various parts of the latching device.
Figure 3:
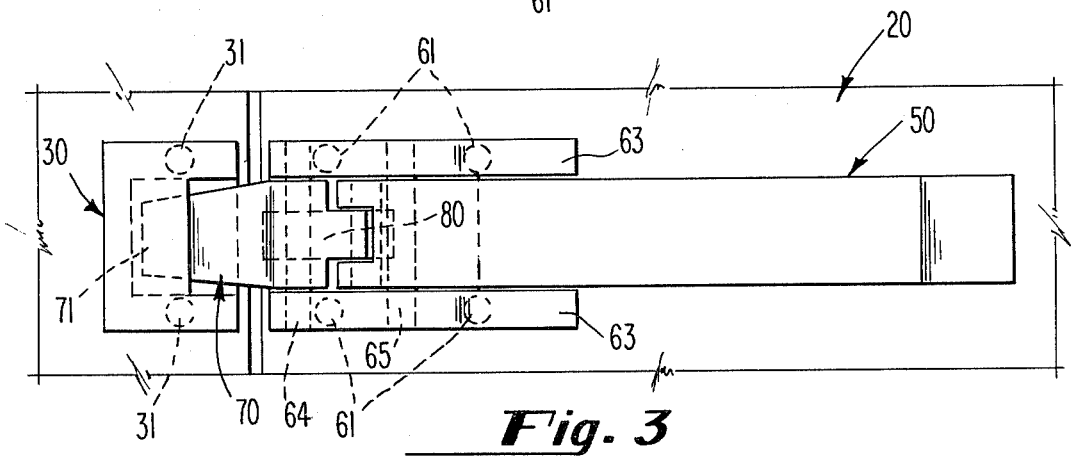
FIG. 3 is a plan view of the latching device of FIG. 1.

Secured to outer surface 14 of frame 10 is a keeper 30 which may be fastened to frame 10 as by screws 31 seen in FIG. 2. Keeper 30 includes a base plate portion 32, side walls 33, a rear wall 34, and, as best seen in cross section in FIGS. 4 and 5, an upper forwardly-projecting portion 35 forming a recess 36 which is adapted to receive the tongue 71 of the latch pawl 70.

A supporting frame 60 for the latch mechanism is secured to the outer surface of door 20 as by screws 61. Frame 60 includes a base plate 62 and a pair of upstanding side plates 63 which carry the latching pawl 70. At one end of pawl 70 is a tongue 71 and at the other end a pair of flanges 72 which define a recess 73.

As indicated in FIG. 2, a pivot pin 64 supports latch pawl 70 in the space between the spaced-apart side plates 63 of the support frame 60. A shorter pivot pin 74 supports one end of a link bar 80 in the recess 73 between the flanges 72 of the pawl 70. A pivot pin 53 supports the other end of link bar 80 in a recess 54 between a pair of flanges 55 at one end of the lever 50. A pin 65 supports lever 50 in the space between the sidewalls 63 of the support frame 60. Base plate 62 of frame 60 has an inclined surface 67 for receiving and supporting the lower end of a compression spring 90. The upper end of compression spring 90 bears against the undersurface of link bar 80 which is recessed for receiving and retaining the upper end of the spring.

Figure 4:
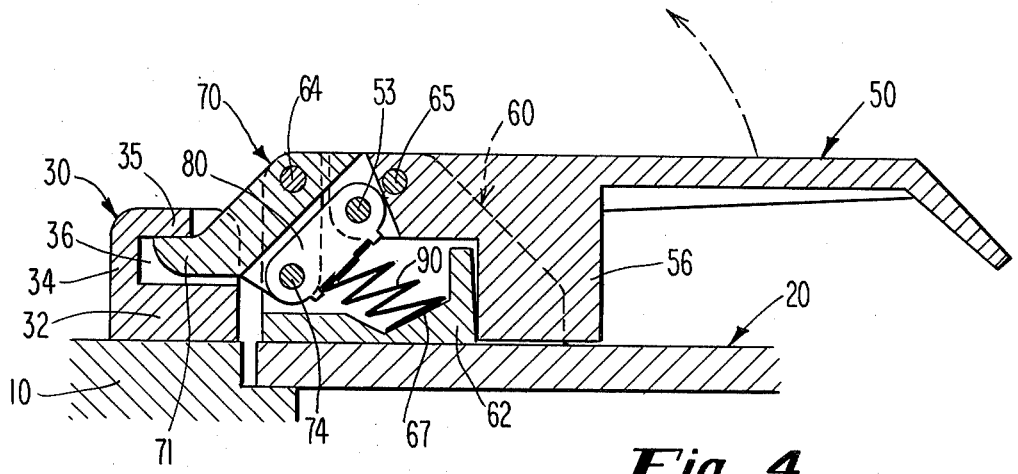
FIG. 4 is an elevational view, in section, taken along the line 4—4 of FIG. 1.

Referring now to FIG. 4, it is pointed out that a thrust force applied to the undersurface of the door 20 in a door-opening direction will be opposed by forces which include that provided by the over-center action of link bar 80. It will be seen that for door 20 to open, the pawl 70 must swing in a counterclockwise direction about the fixed pivot pin 64. For this to happen, the link pivot pin 74, which is carried by the pawl 70, must also swing counterclockwise about the fixed pivot pin 64. But link pivot pin 74 is unable to swing counterclockwise about pivot pin 64 unless the pivot 53 at the other end of the link bar 80 has previously been moved in a counterclockwise direction about the fixed pivot pin 65 to a position beyond the critical point which is a point located on a straight line constructed through the centers of pins 74 and 65. Thus, when the latch mechanism is in a position illustrated in FIG. 4, strong forces oppose opening of door 20.

Figure 5:
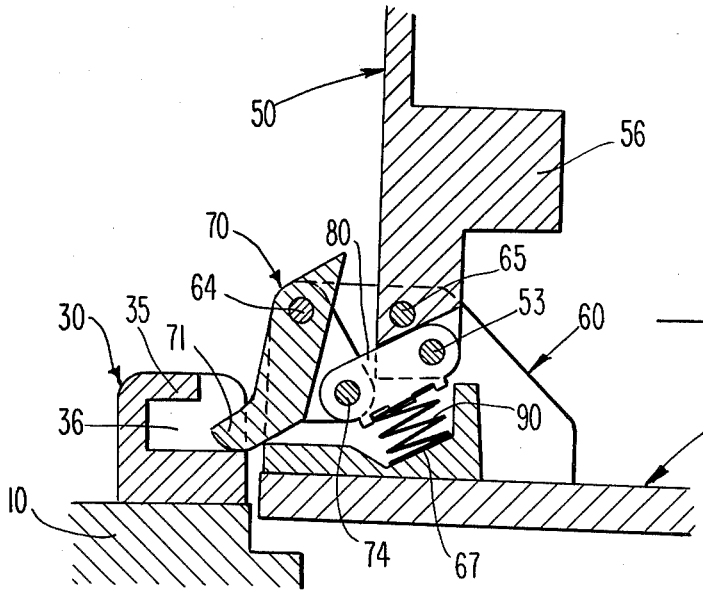
FIG. 5 is an elevational view, in section, showing the latch in unlatched open position.

FIG. 5 illustrates the latch in unlatched door-opening position. In this position, lever 50 has been manually pulled in the counterclockwise direction indicated by the arrow in FIG. 4, and link pivot pin 53 has been moved pivotally in a counterclockwise direction about the fixed pivot pin 65 beyond the critical point. Link bar 80 has pulled link pivot pin 74 in a counterclockwise direction about fixed pivot pin 64, the pawl 70 has been pulled counterclockwise about pivot pin 64 from the position shown in FIG. 4 to the position shown in FIG. 5. The tongue 71 of pawl 70 has cleared the upper portion 35 of the keeper 30 and, thus, the latch has been unlatched and door 20 is free to be opened.

An inspection of FIGS. 4 and 5 will reveal that the latching mechanism of the present application is also effective in releasing a stuck or frozen door. It will be seen that when the lever 50 is pivoted in a counterclockwise direction about the fixed pivot pin 65, the link pivot pin 53 is caused to move counterclockwise about the pivot pin 65 and in so doing pulls the link pivot pin 74 in a similar direction about the fixed pivot pin 64. This causes the tongue 71 of the pawl 70 to move counterclockwise about the pivot pin 64. In so moving, the undersurface of the tongue 71 bears against the upper surface of the base plate 32 of the keeper 30 and forces the pin 64 outwardly, thereby forcing outwardly the latch-supporting frame 60 and the door 20 to which it is affixed.

Figure 6:
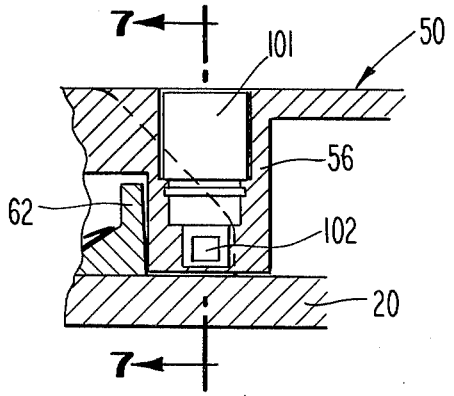
FIG. 6 is a view of a lock which may optionally be provided.
Figure 7:
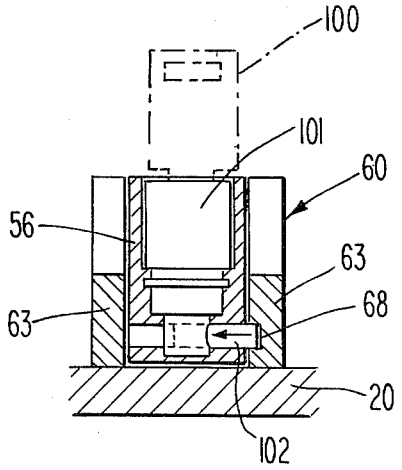
FIG. 7 is a view of the lock looking along the line 7—7 of FIG. 6.

In FIGS. 6 and 7 there is illustrated a lock which may optionally be provided for the latching mechanism of FIGS. 1–5. In FIGS. 6 and 7, the portion 56 of the lever 50 is provided with a cylindrical recess containing the barrel 101 of a lock having a bolt 102. When key 100, shown in phantom in FIG. 7 is operated, bolt 102 enters recess 68 in sidewall 63 of frame 60, thereby locking the lever 50 to the frame 60.

What is claimed is:

1. A latching device for a door, said latching device comprising:

a. keeper means secured to the frame of the door;

b. pawl means, lever means, toggle link means and compression spring means mounted on said door in a position such that the nose portion of said pawl means may engage said keeper means when said door is moved toward and into closed position, said toggle link means connecting said pawl means to said lever means;

c. said pawl and lever means being structurally related to be rotated manually about first and second fixed pivot points and held between over-the-center latching and unlatching postions by said toggle link means;

d. said compression spring means engaging said toggle link means and adapted to bias said pawl and lever means in each of its over-centered latching and unlatching positions;

e. said keeper means having a recess for receiving the nose portion of said pawl means, said recess having an upper keeper portion against which the nose portion of said pawl means is adapted to bear;

f. said keeper means adapted to be engaged by the nose portion of said pawl means when said lever means is manually operated to move said pawl means to latching position;

g. said keeper means having a base portion which projects toward said pawl means relative to said upper keeper portion and is adapted to be engaged by the nose portion of said pawl when said lever means is in unlatched position and said door is moved or slammed toward shut position, said nose portion of said pawl engaging said projecting base portion and starting movement of said lever and pawl toward latching position, said compression spring means become further compressed during the first portion of said movement toward latching position, said compression spring means, after said toggle link means passes through center position, functioning to apply a force to continue the movement of said lever and pawl toward its over-the-center latched position.

* * * * *